United States Patent [19]

Hollingshad

[11] 3,932,303

[45] Jan. 13, 1976

[54] CORROSION INHIBITION WITH TRIETHANOLAMINE PHOSPHATE ESTER COMPOSITIONS

[75] Inventor: William Robert Hollingshad, Bethel Park, Pa.

[73] Assignee: Calgon Corporation, Pittsburgh, Pa.

[22] Filed: June 4, 1973

[21] Appl. No.: 367,079

[52] U.S. Cl. ..... 252/389 A; 21/2.7 R; 21/2.7 A; 252/180; 252/181; 252/389 R; 252/390; 210/58

[51] Int. Cl.[2] ..... C23F 11/16; C23F 11/14

[58] Field of Search ..... 252/389 A, 389 R, 180, 252/181, 390; 21/2.7 A, 2.7 R, 2.5 A, 2.5 R; 210/58

[56] References Cited

UNITED STATES PATENTS

| | | | |
|---|---|---|---|
| 3,388,191 | 6/1968 | Cybe | 252/389 A |
| 3,510,436 | 5/1970 | Silverstein et al. | 252/389 A |
| 3,620,974 | 11/1971 | Stanford et al. | 252/389 A |
| 3,663,448 | 5/1972 | Ralston | 21/2.7 A |
| 3,699,048 | 10/1972 | Krueger et al. | 21/2.7 A |
| 3,751,372 | 7/1973 | Zecher | 21/2.7 A |

*Primary Examiner*—Benjamin R. Padgett
*Assistant Examiner*—Irwin Gluck
*Attorney, Agent, or Firm*—Rudolph J. Anderson, Jr.; Harry E. Westlake; Martin L. Katz

[57] ABSTRACT

Use of alkanolamine phosphate ester and at least one member selected from the group consisting of phosphates, phosphonates, and low molecular weight polymers to inhibit the corrosion of metals by oxygen-bearing waters.

10 Claims, No Drawings

CORROSION INHIBITION WITH TRIETHANOLAMINE PHOSPHATE ESTER COMPOSITIONS

BACKGROUND OF THE INVENTION

This invention relates to the inhibition of corrosion in water systems which utilize oxygen-bearing waters.

More particularly, this invention relates to the use of compositions comprising alkanolamine phosphate esters and at least one member selected from the group consisting of phosphates, phosphonates, and low molecular weight polymers to inhibit the corrosion of metals in water systems which contain oxygen-bearing waters.

Oxygen corrosion is, of course, a serious problem in any metal-containing water system. The corrosion of iron and steel is of principal concern because of their extensive use in many types of water systems. Copper and its alloys, aluminum and its alloys, and galvanized steel are also used in water systems and are subject to corrosion. I have discovered corrosion inhibitors which will inhibit oxygen corrosion in water systems containing such metals.

SUMMARY OF THE INVENTION

I have found that compositions comprising an alkanolamine phosphate ester and at least one member selected from the group consisting of phosphates, phosphonates, and low molecular weight polymers are effective corrosion inhibitors.

Suitable alkanolamine phosphate esters include the phosphate esters of mono-, di-, and triethanolamine; mono-, di-, and trisisopropylamine; mono-, di-, and iso-butanolamine; and butanolamine. The preferred compound, however, is triethanolamine.

Suitable phosphates include any source of the ortho-$PO_4^{-3}$ ion as, for example, phosphoric acid, mono- di-, and tri-sodium phosphate, or any of the sodium polyphosphates, while suitable phosphonates include compounds of the formula:

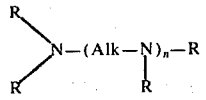

(See U.S. Pat. Nos. 2,599,807 and 2,609,390) where Alk is any alkylene carbon group ($C_nH_{2n}$) containing 2 to 6 carbon atoms, each R may be H, $-CH_2COOM$, or:

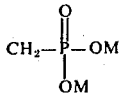

M is H or a cation forming a water-soluble salt and $n$=0 to 14 provided, however, that where $n$=0 at least one of the radicals represented by R is:

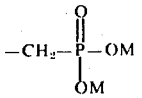

and where $n$ is greater than zero at least ½ of the radicals represented by R is:

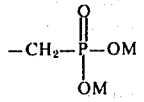

Amino tris (methylphosphonic acid) and its water-soluble salts are preferred compositions.

Suitable polymers include water-soluble salts of acrylates and methacrylates, unhydrolyzed or partially hydrolyzed acrylamides, and acrylamidomethyl propane sulfonates. The polymers may be homo-, co-, or ter- polymers of any of the aforementioned polymers and may have a molecular weight of from about 500 to about 10,000. The preferred molecular weight, however, is about 1,000.

The corrosion-inhibiting compositions can contain a ratio of alkanolamine phosphate ester to the member selected from the group consisting of phosphates, phosphonates, and low molecular weight polymers of from about 5:1 to about 1:15 by weight. The preferred ratio, however, is from about 3:1 to 1:4 by weight. When more than one member from the group consisting of phosphates, phosphonates, and polymers is used, each member may be present in varying amounts depending on the particular application. These compositions will effectively inhibit corrosion of metals when maintained in a water system at a concentration of at least about 10 ppm at the above ratios and, preferably, about 50 ppm. Maximum concentrations are determined by the economic considerations of the particular application.

It may, of course, be desirable to add zinc to the compositions of this invention for certain applications. The zinc ion may be supplied in many ways. For example, it may be added by utilizing a water-soluble zinc salt, such as, zinc chloride, zinc acetate, zinc nitrate, or zinc sulfate or it may be supplied by adding powdered zinc to a solution of the composition.

Compounds such as benzotriazole or mercaptobenzothiazole may also be added to the final formulation in varying amounts to improve its usefulness in a wider variety of industrial applications where both steel and copper are present in the same system.

The following tables show the results of experiments which demonstrate the effectiveness of the compositions of this invention in inhibiting metallic corrosion. These tests were run in synthetic Pittsburgh water. Steel electrodes were used in polarization test cells with the initial pH at 7.0. Inhibitor concentrations were calculated on the basis of 100 percent active material. The amount of corrosion that had taken place was determined from the current density at the intersection of an extrapolation of the so-called "Tafel" portion of the anodic polarization curve with the equilibrium or "mixed" potential value, usually referred to as the corrosion potential, "$E_{corr}$." application of Faraday's Law allows a computation of a direct mathematical relationship between the current density at $E_{corr}$, expressed in amperes per square centimeter and a more useful corrosion rate expression such as milligrams of steel consumed per square decimeter of surface per day (m.d.d.) and mils per year (m.p.y.). This relationship is such that a current density value of $4.0 \times 10^{-7}$ amperes/$cm_2$ = 1.0 mg/$dm^2$/day. Further, the m.p.y. value is calculated from the formula: m.p.y. = m.d.d. ×

1.44/density, using a density value of 7.87 g/cm$^3$ for steel.

The following table illustrates the effect of a corrosion-inhibiting composition comprising an alkanolamine phosphate ester and a source of o-phosphate in tests run at 35°C.

Table 1

| Inhibitor System | Dosage (mg/l) | Corrosion Rate (mdd) |
|---|---|---|
| Control | 0 | 100 |
| Triethanolamine Phosphate Ester | 14 | 25 |
| Phosphoric Acid | 7 | 25 |
| Triethanolamine Phosphate Ester + Phosphoric Acid | 14 + 7 | 10 |

The following table illustrates the effect of a corrosion-inhibiting composition comprising an alkanolamine phosphate ester and a phosphonate in tests run at 35°C.

Table 2

| Inhibitor System | Dosage (mg/l) | Corrosion Rate (mdd) |
|---|---|---|
| Control | 0 | 100 |
| Triethanolamine Phosphate Ester | 10 | 25 |
| Amino tris (methylphosphonic acid) | 15 | 50 |
| Triethanolamine Phosphate Ester + Amino tris (methylphosphonic acid) | 10 + 15 | 6 |

The following table illustrates the effect of a corrosion-inhibiting composition comprising an alkanolamine phosphate ester, a phosphonate, and a source of o-phosphate in tests run at 35°C.

Table 3

| Inhibitor System | Dosage (mg/l) | Corrosion Rate (mdd) |
|---|---|---|
| Control | 0 | 100 |
| Amino tris (methylphosphonic acid) | 15 | 50 |
| Phosphoric Acid | 7 | 25 |
| Triethanolamine Phosphate Ester | 14 | 25 |
| Amino tris (methylphosphonic acid) + Phosphoric Acid + Triethanolamine Phosphate Ester | 15 + 7 + 14 | 6 |

The following table illustrates the effect of a corrosion-inhibiting composition comprising an alkanolamine phosphate ester, a polymer, and a source of o-phosphate in tests run at 35°C.

Table 4

| Inhibitor System | Dosage (mg/l) | Corrosion Rate (mdd) |
|---|---|---|
| Control | 0 | 100 |
| Triethanolamine Phosphate Ester | 5 | 52 |
| Sodium Polyacrylate (molecular weight approx. 1,000) | 30 | 78 |
| Phosphoric Acid | 5 | 83 |
| Triethanolamine Phosphate Ester + Sodium Polyacrylate (molecular weight approx. 1,000) + Phosphoric Acid | 5 + 30 + 5 | 4 |

I claim:

1. A composition useful for inhibiting the corrosion of metals in a water system which comprises a triethanolamine phosphate ester and at least one member selected from the group consisting of phosphoric acid, phosphonates, and a polyacrylate having a molecular weight of from about 500 to about 10,000.

2. A composition as in claim 1 wherein the phosphonate is a composition of the formula:

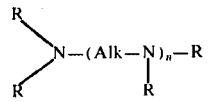

where Alk is any alkylene carbon group containing 2 to 6 carbon atoms, R may be a member selected from the group consisting of H, $-CH_2COOM$ and:

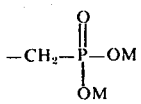

M is a member selected from the group consisting of H and a cation forming a water-soluble salt, $n = 0$ to 14 provided, however, that where $n = 0$ at least one of the radicals represented by R is:

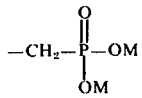

and where $n$ is greater than zero at least ½ of the radicals represented by R is:

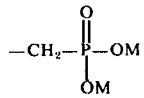

3. A composition as in claim 2 wherein the phosphonate is amino tris (methylphosphonic acid) or the soluble salts thereof.

4. A composition as in claim 1 which further contains zinc.

5. A composition as in claim 1 further comprises a member selected from the group consisting of benzotriazole and mercaptobenzothiazole.

6. A method of inhibiting the corrosion of metals in a water system which comprises maintaining in the water of said system at least about 10 ppm of a composition comprising a triethanolamine phosphate ester and at least one member selected from the group consisting of phosphoric acid, phosphonates, and a polyacrylate having a molecular weight of from about 500 to about 10,000.

7. A method as in claim 6 wherein the phosphonate is a composition of the formula:

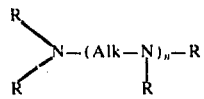

where Alk is any alkylene carbon group containing 2 to 6 carbon atoms, R may be a member selected from the group consisting of H, $-CH_2COOM$ and:

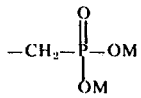

M is a member selected from the group consisting of H and a cation forming a water-soluble salt, $n = 0$ to 14 provided, however, that where $n = 0$ at least one of the radicals represented by R is:

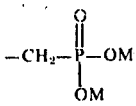

and where $n$ is greater than zero at least ½ of the radicals represented by R is:

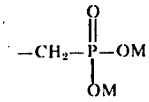

8. A method as in claim 7 wherein the phosphonate is amino tris (methylphosphonic acid) or the soluble salts thereof.

9. A method as in claim 6 which further contains zinc.

10. A method as in claim 6 which further comprises a member selected from the group consisting of benzotriazole and mercaptobenzothiazole.

* * * * *

UNITED STATES PATENT AND TRADEMARK OFFICE

CERTIFICATE OF CORRECTION

PATENT NO. : 3,932,303

DATED : January 13, 1976

INVENTOR(S) : William Robert Hollingshad

It is certified that error appears in the above-identified patent and that said Letters Patent are hereby corrected as shown below:

Column 2, line 67 "$cm_2$" should read -- $cm^2$ --.

Column 4, claim 5, line 61 after "claim 1" insert -- which --.

Signed and Sealed this

*sixth* Day of *April 1976*

[SEAL]

*Attest:*

RUTH C. MASON
*Attesting Officer*

C. MARSHALL DANN
*Commissioner of Patents and Trademarks*